US006823782B2

(12) United States Patent
Hashimoto et al.

(10) Patent No.: US 6,823,782 B2
(45) Date of Patent: Nov. 30, 2004

(54) STENCIL PRINTING MACHINE

(75) Inventors: Hirohide Hashimoto, Ibaraki-ken (JP); Yosuke Ike, Ibaraki-ken (JP); Mitsuru Takeno, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 150 days.

(21) Appl. No.: 09/991,751

(22) Filed: Nov. 26, 2001

(65) Prior Publication Data

US 2002/0062747 A1 May 30, 2002

(30) Foreign Application Priority Data

Nov. 27, 2000 (JP) ..... P2000-359935
Apr. 11, 2001 (JP) ..... P2001-112542

(51) Int. Cl.[7] ..... B41L 13/04; B41L 21/00
(52) U.S. Cl. ..... 101/116; 101/118; 101/420
(58) Field of Search ..... 101/115, 116, 101/118, 123, 423, 424, 425, 416.1, 419, 420

(56) References Cited

U.S. PATENT DOCUMENTS 5,243,909 A * 9/1993 DeMoore et al. ..... 101/420
5,320,042 A * 6/1994 Schwopfinger ..... 101/416.1
5,509,353 A * 4/1996 Aoki ..... 101/425
5,673,619 A * 10/1997 Ohinata et al. ..... 101/116
5,724,888 A * 3/1998 Okuda et al. ..... 101/116
6,010,935 A * 1/2000 Doan ..... 438/303
6,119,597 A * 9/2000 DeMoore et al. ..... 101/483

FOREIGN PATENT DOCUMENTS

JP 08-090893 4/1996

* cited by examiner

*Primary Examiner*—Ren Yan
(74) *Attorney, Agent, or Firm*—Nath & Associates PLLC; Gary M. Nath; Marvin C. Berkowitz

(57) ABSTRACT

A stencil printing machine 1 is provided as including a downstream rotary printing drum 50 with an outer circumferential periphery 50*a* mounted with a stencil sheet 20, and a rotary press roller 56 which is moveable between a pressurized position to press an outer circumferential periphery 50*a* of the printing drum 50 and a separated position displaced from the outer circumferential periphery 50*a* of the printing drum 50, wherein a print sheet 45, which is fed, is pressed and transferred between the printing drum 50 and the press roller 56 which rotate together, and, during such a pressurized transfer stage, ink is transferred to the print sheet 45 to perform printing operation. The outer circumferential periphery of the press roller 56 is formed with micro-convexities and concavities.

23 Claims, 12 Drawing Sheets

FIG.4

| | MESH NUMBER | DISTANCE BETWEEN APEXES (mm) | DEPTH IN CONV. AND CONC. (mm) | VISCOSITY OF SILICONE OIL (mPa·s) | CONTAMI-NATED STATUS | IMAGE QUALITY AT LOWER SURFACE |
|---|---|---|---|---|---|---|
| 1ST PREF. EMBOD. | #30 | 0.85 | 0.27 | — | ○ | × |
| | #40 | 0.64 | 0.21 | — | ○ | ○ |
| | #60 | 0.42 | 0.12 | — | ○ | ○ |
| | #80 | 0.32 | 0.095 | — | ○ | ○ |
| | #100 | 0.25 | 0.062 | — | ○ | ○ |
| | #150 | 0.17 | 0.044 | — | ○ | ○ |
| | #230 | 0.11 | 0.035 | — | ○ | ○ |
| | #305 | 0.08 | 0.027 | — | △ | ○ |

FIG.5

| | MESH NUMBER | DISTANCE BETWEEN APEXES (mm) | DEPTH IN CONV. AND CONC. (mm) | VISCOSITY OF SILICONE OIL (mPa·s) | CONTAMI-NATED STATUS | IMAGE QUALITY AT LOWER SURFACE |
|---|---|---|---|---|---|---|
| 2ND PREF. EMBOD. | #30 | 0.85 | 0.27 | 100 | ◎ | × |
| | #40 | 0.64 | 0.21 | 100 | ◎ | ○ |
| | #60 | 0.42 | 0.12 | 100 | ◎ | ○ |
| | #80 | 0.32 | 0.095 | 100 | ◎ | ○ |
| | #100 | 0.25 | 0.062 | 100 | ◎ | ○ |
| | #150 | 0.17 | 0.044 | 100 | ◎ | ○ |
| | #230 | 0.11 | 0.035 | 100 | ○ | ○ |
| | #305 | 0.08 | 0.027 | 100 | △ | ○ |

FIG.6

| | MESH NUMBER | DISTANCE BETWEEN APEXES (mm) | DEPTH IN CONV. AND CONC. (mm) | VISCOSITY OF SILICONE OIL (mPa·s) | CONTAMI-NATED STATUS | IMAGE QUALITY AT LOWER SURFACE |
|---|---|---|---|---|---|---|
| 3RD PREF. EMBOD. | #80 | 0.32 | 0.095 | 10 | ◎ | ○ |
| | | | | 100 | ◎ | ○ |
| | | | | 500 | ◎ | ○ |
| | | | | 1000 | ○ | ○ |
| | | | | 5000 | △ | ○ |

FIG.7

| COMPARISON RUBBER ROLLER | MESH NUMBER | DISTANCE BETWEEN APEXES (mm) | DEPTH IN CONV. AND CONC. (mm) | VISCOSITY OF SILICONE OIL (mPa·s) | CONTAMI-NATED STATUS | IMAGE QUALITY AT LOWER SURFACE |
|---|---|---|---|---|---|---|
| | — | — | — | — | × | ○ |

STENCIL PRINTING MACHINE

BACKGROUND OF THE INVENTION

The present invention relates to stencil printing machines for transferring print medium in pressured state between a printing drum, to which a stencil sheet is mounted, and a press rotary member to press the printing drum to perform a printing operation and, more particularly, to a stencil printing machine having two sets of printing drums and press rotary members for performing a double-face printing operation.

FIG. 1 shows a schematic overall structure of a conventional a stencil printing machine that enables a double-face printing operation. As shown in FIG. 1, the stencil printing machine 100 is constructed of upstream and downstream stencil making sections 104, 105 with respective thermal printing heads 102, 103 for thermally perforating respective stencil sheets 101, 101 on the basis of respective image data, an upstream printing section 109 wherein the stencil sheet 101 made in the upstream stencil making section 104 is mounted onto an upstream printing drum 106 and a print sheet 107, which is fed thereto, is transferred through a path between the upstream printing drum 106 and a press roller 108 in a pressured contact relationship to transfer ink onto an upper surface (one surface) of the print sheet 107 during such a transfer step, a paper feed section 110 which feeds the print sheet 107 to the upstream printing section 109, an upstream belt-conveyer transfer unit 111 located at a sheet discharge side of the upstream printing section and transferring the print sheet 107 to a downstream side with the action of a belt 121, a downstream printing section wherein the stencil sheet 101, which is made in the downstream stencil making section 105, is mounted onto a downstream printing drum 112 and the print sheet, which is fed from the upstream belt conveyer transfer unit 111, is transferred through a path between the printing drum 112 and a press roller 114 in a pressured contact relationship to transfer ink onto a lower surface (the other surface) of the print sheet 107 during such a transfer step, and a downstream belt-conveyer transfer unit 117 with a belt 122 located at a sheet discharge side of the downstream printing section 115 for transferring the print sheet 107 to a sheet discharge tray 116 located in a downstream side.

Further, the upstream and downstream printing sections 109, 115 include squeegee rollers 123, 123 located inside the printing drums 106, 112, respectively, and held in contact with inner surfaces of outer peripheral walls 106*a*, 112*a* of the respective printing drums 106, 112, doctor rollers 124, 124 located in close proximity to the squeegee rollers 123, 123, respectively, to form respective given gaps relative thereto, and ink supply units 125, 125 each for supplying ink to an each area between the rollers 123, 124, with the squeegee rollers 123, 123 being arranged to rotate on inner peripheral surfaces of the outer peripheral walls 106*a*, 112*a* in association with rotations of the respective printing drums 106, 112. In addition, as the squeegee rollers 123, 123 rotate with the rotations of the printing drums 106, 112, the outer peripheral surfaces of the squeegee rollers 123, 123 are adhered with ink in a given film thickness, with the adhered ink being transferred to the outer peripheral walls 106*a*, 112*a* to allow ink to be supplied to an inner side of the stencil sheet 101 at all times.

Now, the double-face printing operation is described below. Rotations of the printing drums 106, 112 allow the print sheet 107 to be fed from the paper feed section 110 to the upstream printing drum 106 in synchronism with the rotation thereof. The print sheet 107, thus fed to the printing drum 106, is brought into pressured contact with the stencil sheet 101 of the printing drum 106 with the press roller 108 to allow ink image to be transferred onto the upper surface of the print sheet 107, with the print sheet 107, whose upper surface is printed, being peeled off from the outer peripheral wall of the printing drum 106 and being introduced to the upstream conveyer-belt transfer unit 111. The upstream belt-conveyer transfer unit 111 causes the belt 121 to move for transferring the print sheet 107 with its lower surface remaining contact with the belt, thereby feeding the print sheet 107 from the most downstream side of the belt 121 to the downstream printing drum 112. The print sheet 107, thus fed to the downstream printing drum 106, is then brought into pressured contact with the stencil sheet 101 of the printing drum 112 with the press roller 114 to transfer ink image onto the lower surface of the print sheet 107, with the print sheet 107, whose lower surface is printed, being peeled off from the outer peripheral wall of the printing drum 112 to be introduced to the downstream belt-conveyer transfer unit 117. The downstream belt-conveyer transfer unit 117 causes the belt 122 to move for transferring the print sheet 107 from the most downstream side of the belt 122 to the sheet discharge tray 116. The print sheet 107 thus discharged to the sheet discharge tray 116 is placed therein in the stacked state.

Also, a similar technology related to such a stencil printing machine 100 is disclosed in Japanese Patent Provisional Publication No. 8-90893.

By the way, in the aforementioned stencil printing machine for the double-phase printing operation, the print sheet 107, whose upper surface has been printed with the upstream printing section 109, is fed to the downstream printing section 115 in a non-fixed ink state to cause the press roller 114 of the downstream printing section 115 to press the upper surface, which remains in the non-fixed ink state, of the print sheet 107. Accordingly, as shown in FIG. 2, the outer circumferential periphery of the press roller 114 and non-fixed ink 130 of the print sheet 107 are brought into surface contact in a wide range. For this reason, when the press roller 114 is separated from the print sheet 107, non-fixed ink area 130 remaining at the contact surface is caused to be split such that a portion of non-fixed ink 130 is adhered to the press roller 114. When this takes place, non-fixed ink is transferred to the press roller 114 and is then transferred to the print sheet 107, providing an issue of contamination in the print sheet 107.

To address such an issue, it is thought for providing a means for washing ink transferred to the press roller 114 with a waste.

However, with such a means for washing ink adhered to the press roller 114, a mechanism for washing becomes complicated in structure and, also, a new issues is encountered in that ink is transferred from the print sheet 107 to the press roller 114, resulting in a decrease in the print density of the print sheet 107.

On the other hand, with such a stencil printing machine which enables only a single-phase printing operation, when the print sheet is not fed between the printing drum and the press roller to cause the press roller to be brought into direct contact with the stencil sheet owing to a jamming operation, when the print sheet whose size is smaller than a lateral size of the stencil sheet and a portion of the press roller is brought into direct contact with the stencil sheet and when the single-phase printing operation is implemented and the other surface of the print sheet in non-fixed ink state is subjected to the printing operation, there are some instances wherein ink is transferred to the press roller and transferred ink is further transferred to the print sheet, with a resultant contamination in the print sheet.

SUMMARY OF THE INVENTION

The present invention has been made to address the aforementioned issue and has an object to provide a stencil printing machine which is able to prevent print medium from being contaminated with little decrease in a print density of print medium with a simplified structure.

An important feature of the invention concerns a stencil printing machine having a printing section composed of a rotary printing drum with an outer circumferential periphery to which a stencil sheet is mounted and a rotary press member which is moveable between a pressurized position to be pressed against the outer circumferential periphery of said printing drum and a separated position to be separated from the outer circumferential periphery of said printing drum, and a paper feed section for feeding print medium between said printing drum and said rotary press member, wherein print medium, fed from the paper feed section, is pressed between and transferred by said printing drum and said rotary press member both of which are rotated together, and during such a pressurized and transfer movement of print medium, print medium is transferred with ink to perform a printing operation, and wherein the stencil printing machine comprises said rotary press member including an outer circumferential periphery formed with micro-convexities and micro-concavities.

With such a stencil printing machine, contamination of print medium is prevented only by providing the micro-convexities and the micro-concavities over the outer circumferential periphery of the rotary press member so that even when the rotary press member is brought into directly pressured contact with the stencil sheet, the rotary press member has a decreased contact surface area with ink, or the outer circumferential periphery of the rotary press member has a reduced contact surface area with the surface, with non-fixed ink, of print medium and, when the rotary press member is separated from the stencil sheet, or when the rotary press member is separated from print sheet, aforementioned ink or non-fixed ink, which remains at a portion with which the rotary press member is not brought into contact, are not adhered to the rotary press member to interrupt the rotary press member from being appreciably adhered with non-fixed ink.

Another important feature of the invention concerns the stencil printing machine wherein said micro-convexities and said micro-concavities of the outer circumferential periphery of said rotary press member has a depth of a value above 0.035 mm.

With such a stencil printing machine, the effect of the invention is obtained and, in addition, when the rotary press member presses the printing drum via print medium, there is a big difference in level in the convexities and the concavities to interrupt the concavities from being practically brought into contact with non-fixed ink of print medium, thereby adequately minimizing transfer of non-fixed ink to the rotary press member.

Another important feature of the invention concerns the stencil printing machine wherein said micro-convexities and said micro-concavities of the outer circumferential periphery of said rotary press member has a depth of a value above 0.044 mm.

With such a stencil printing machine, the effect of the invention is obtained and, in addition, when the rotary press member presses the printing drum via print medium, there is an adequately big difference in level in the convexities and the concavities such that the concavities have little or no contact with non-fixed ink of print medium, thereby further minimizing transfer of non-fixed ink to the rotary press member.

Another important feature of the invention concerns the stencil printing machine wherein a distance between apexes of said micro-convexities and said micro-concavities of the outer circumferential periphery of said rotary press member has a value below 0.64 mm.

With such a stencil printing machine, the effects of the invention is obtained and, in addition, when the rotary press member presses the printing drum via print medium, there is a narrow distance between the convexities and the concavities formed over the outer circumferential periphery of the rotary press member, interrupting the print image from appearing a visible convexity and concavity pattern.

Another important feature of the invention concerns the stencil printing machine wherein said micro-convexities and said micro-concavities of the outer circumferential periphery of said rotary press member are composed of point-like convexities and concavities.

With such a stencil printing machine, the effects of the invention are obtained and, in addition, the convexities and the concavities can be uniformly formed in either direction over the outer circumferential periphery of the rotary press member.

Another important feature of the invention concerns the stencil printing machine wherein said micro-convexities and said micro-concavities of the outer circumferential periphery of said rotary press member are composed of line-shaped convexities and concavities which are orientated in the same direction as that which print medium is transferred.

With such a stencil printing machine, the effects of the invention are obtained and, in addition, the convexities and the concavities can be regularly and distinctly formed over the outer circumferential periphery of the rotary press member in a direction perpendicular an axial direction thereof.

Another important feature of the invention concerns the stencil printing machine wherein said micro-convexities and said micro-concavities of the outer circumferential periphery of said rotary press member are formed by locating a screen mesh to a surface of said rotary press member.

With such a stencil printing machine, the effect of the invention is obtained and, in addition, the screen mesh per se is individually prepared whereupon the screen mesh is located over the outer circumferential periphery of the rotary press member by covering or by adhering for thereby enabling formation of the micro-convexities and the micro-concavities.

Another important feature of the invention concerns the stencil printing machine wherein said point-like micro-convexities and micro-concavities of the outer circumferential periphery of said rotary press member are formed by locating a large number of spherical bodies to a surface of said rotary press member.

With such a stencil printing machine, the effect of the invention is obtained and, in addition, the large number of spherical bodies per se are individually prepared whereupon the spherical bodies are located over the outer circumferential periphery of the rotary press member by adhesion for thereby enabling formation of the micro-convexities and the micro-concavities.

Another important feature of the invention concerns the stencil printing machine, which further comprises a liquid application unit for applying liquid to the outer circumferential periphery of said rotary press member.

With such a stencil printing machine, the effect of the invention is obtained and, in addition, during separating movement between the rotary press member and print medium, a non-fixed ink area is not split whereas a liquid area is split, thereby preventing non-fixed ink from being adhered to the rotary press member.

Another important feature of the invention concerns the stencil printing machine, wherein said liquid has a viscosity of a value below 1000 millipascal·second (mPa·s).

With such a stencil printing machine, the effect of the invention is obtained and, in addition, during separating movement between the rotary press member and print medium, the liquid area, which has the low viscosity, is reliably split, thereby preventing non-fixed ink from being adhered to the rotary press member.

Another important feature of the invention concerns the stencil printing machine, wherein said liquid has a viscosity of a value below 500 millipascal·second (mPa·s).

With such a stencil printing machine, the effect of the invention is obtained and, in addition, during separating movement between the rotary press member and print medium, the liquid area, which has the lower viscosity, is more reliably split, thereby preventing non-fixed ink from being adhered to the rotary press member.

Another important feature of the invention concerns the stencil printing machine, wherein said liquid is composed of silicone oil.

With such a stencil printing machine, the effects of the invention are obtained with the use of silicone oil.

Another important feature of the invention concerns the stencil printing machine, wherein said liquid application unit comprises a rotary liquid application roller held in pressured contact with said rotary press member, and a liquid supply unit for supplying liquid to an outer circumferential periphery of said liquid application roller, wherein said liquid application roller is rotatable with said rotary press member to apply liquid, supplied by said liquid supply unit, to the outer circumferential periphery of said rotary press member.

With such a stencil printing machine, the effect of the invention is obtained and, in addition, the liquid application roller rotates with the rotary press member to apply liquid to the rotary press member.

Another important feature of the invention concerns the stencil printing machine, wherein said liquid application unit comprises a sheet-like member held in abutting contact with said rotary press member and impregnated with liquid, said sheet-like member being moveable while held in abutting contact with said rotary press member.

With such a stencil printing machine, the effect of the invention is obtained and, in addition, the sheet-like member, impregnated with liquid, enables to be brought into abutting contact with the rotary press member at variable positions.

Another important feature of the invention concerns the stencil printing machine, wherein said liquid application unit comprises a biasing member held in abutting contact with said rotary press member and impregnated with liquid which is retained in said biasing member, and a liquid supply unit for supplying liquid to the outer circumferential periphery of said rotary press member at a point upstream of said biasing member in a direction which said rotary press member rotates.

With such a stencil printing machine, the effect of the invention is obtained and, in addition, liquid is first supplied to the rotary press member with the liquid supply unit and is then smoothly applied over the outer circumferential periphery of the rotary press member with the biasing member, enabling adjustment of the amount of liquid to be applied to the rotary press member with the liquid supply unit.

Another important feature of the invention concerns the stencil printing machine, wherein said liquid application unit comprises a sheet-like member held in abutting contact with said rotational press member at an adjustable contact area and moveable to vary the position of said adjustable contact area, and a liquid supply unit for supplying liquid to the outer circumferential periphery of said rotary press member at a point upstream of said adjustable contact area of said sheet-like member in a direction which said rotary press member rotates.

With such a stencil printing machine, the effect of the invention is obtained and, in addition, liquid is first supplied to the rotary press member with the liquid supply unit and is then smoothly applied over the outer circumferential periphery of the rotary press member with the sheet-like member which can be brought into abutting contact with the rotary press member at variable positions, thereby enabling adjustment of the amount of liquid to be applied to the rotary press member with the liquid supply unit.

Another important feature of the invention concerns the stencil printing machine which has two sets of printing sections located at an upstream side and a downstream side, respectively, and each composed of a rotary printing drum with an outer circumferential periphery to which a stencil sheet is mounted and a rotary press member which is movable between a pressurized position to be pressed against the outer circumferential periphery of the printing drum and a separated position to be separate from the outer circumferential periphery, a paper feed section for feeding print medium to the printing section at the upstream side, and an upstream transfer mechanism for transferring and feeding print medium, discharged from the printing section at the upstream side, to the printing section at the downstream side, wherein print medium, fed from the paper feed section to the printing section at the upstream side, is pressed between and transferred by the printing drum at the upstream side and the rotary press member both of which are rotated together, and during such a pressurized and transfer movement of print medium, one surface of print medium is transferred with ink and print medium is then fed to the printing section at the downstream side with the upstream transfer mechanism to allow print medium to be pressurized between and transferred by the printing drum and the rotary press member at the downstream side such that during such a pressurized and transfer movement, the other surface of print medium is transferred with ink to perform a double-phase printing operation, and which comprises at least said rotary press member, located at the downstream side, including an outer circumferential periphery formed with micro-convexities and micro-concavities.

With such a stencil printing machine, the effect of the invention defined in claim 17 is obtained and, in addition, when the rotary press member presses the printing drum via print medium, there is a big difference in level in the convexities and the concavities to interrupt the concavities from being practically brought into contact with non-fixed ink of print medium, thereby adequately minimizing transfer of non-fixed ink to the rotary press member.

Another important feature of the invention concerns the stencil printing machine wherein said micro-convexities and said micro-concavities of the outer circumferential periphery of said rotary press member has a depth of a value above 0.035 mm.

With such a stencil printing machine, the effect of the invention is obtained and, in addition, when the rotary press member presses the printing drum via print medium, there is a big difference in level in the convexities and the concavities to interrupt the concavities from being practically brought into contact with non-fixed ink of print medium, thereby adequately minimizing transfer of non-fixed ink to the rotary press member.

Another important feature of the invention concerns the stencil printing machine wherein said micro-convexities and said micro-concavities of the outer circumferential periphery of said rotary press member has a depth of a value above 0.044 mm.

With such a stencil printing machine, the effect of the invention is obtained and, in addition, when the rotary press member presses the printing drum via print medium, there is an adequately big difference in level in the convexities and the concavities such that the concavities have little or no contact with non-fixed ink of print medium, thereby further minimizing transfer of non-fixed ink to the rotary press member.

Another important feature of the invention concerns the stencil printing machine wherein a distance between apexes of said micro-convexities and said micro-concavities of the outer circumferential periphery of said rotary press member has a value below 0.64 mm.

With such a stencil printing machine, the effects of the invention is obtained and, in addition, when the rotary press member presses the printing drum via print medium, there is a narrow distance between the convexities and the concavities formed over the outer circumferential periphery of the rotary press member, interrupting the print image from appearing a visible convexity and concavity pattern.

Another important feature of the invention concerns the stencil printing machine wherein said micro-convexities and said micro-concavities of the outer circumferential periphery of said rotary press member are composed of point-like convexities and concavities.

With such a stencil printing machine, the effects of the invention are obtained and, in addition, the convexities and the concavities can be uniformly formed in either direction over the outer circumferential periphery of the rotary press member.

Another important feature of the invention concerns the stencil printing machine wherein said micro-convexities and said micro-concavities of the outer circumferential periphery of said rotary press member are composed of line-shaped convexities and concavities which are orientated in the same direction as that which print medium is transferred.

With such a stencil printing machine, the effects of the invention are obtained and, in addition, the convexities and the concavities can be regularly and distinctly formed over the outer circumferential periphery of the rotary press member in a direction perpendicular an axial direction thereof.

Another important feature of the invention concerns the stencil printing machine, which further comprises a liquid application unit for applying liquid to the outer circumferential periphery of said rotary press member.

With such a stencil printing machine, the effect of the invention is obtained and, in addition, during separating movement between the rotary press member and print medium, a non-fixed ink area is not split whereas a liquid area is split, thereby preventing non-fixed ink from being adhered to the rotary press member.

BRIEF DESCRIPTION OF THE DRAWINGS

FIG. 4 is a view illustrating an evaluated result in terms of a contaminated status and an image quality which is attained in a first preferred embodiment (wherein a downstream press roller has an outer circumferential periphery formed with micro-convexities and concavities and wherein the press roller is not applied with silicone oil with a liquid application roller) of the present invention;

FIG. 5 is a view illustrating the evaluated result in terms of the contaminated status and the image quality which is attained in a second preferred embodiment (wherein the downstream press roller has the outer circumferential periphery formed with the micro-convexities and concavities and wherein the press roller is slightly applied with silicone oil with the liquid application roller) of the present invention;

FIG. 6 is a view illustrating the evaluated result in terms of the contaminated status and the image quality which is attained in a third preferred embodiment (wherein the downstream press roller has the outer circumferential periphery formed with the micro-convexities and concavities and wherein the press roller is applied with silicone oil with the liquid application roller) of the present invention;

FIG. 7 is a view illustrating the evaluated result in terms of the contaminated status and the image quality which is attained in a comparison (wherein the downstream press roller is made of natural rubber material and has an outer circumferential periphery with a flat surface without the micro-convexities and concavities and wherein the press roller is not applied with silicone oil with the liquid application roller) of the present invention;

FIGS. 12A and 12B show a detailed structure of a fourth preferred embodiment according to the present invention, wherein FIG. 12A is a front view of the press roller and FIG. 12B is an enlarged cross sectional view of a part of the structure shown in FIG. 12A;

FIGS. 13A and 13B show another detailed structure of a fifth preferred embodiment according to the present invention, wherein FIG. 13A is a front view of the press roller and FIG. 13B is an enlarged cross sectional view of a part of the structure shown in FIG. 12A;

FIGS. 14A and 14B show a structure of the sixth preferred embodiment according to the present invention, wherein FIG. 14A is an overall structural view of a liquid application unit and FIG. 14B is a schematic perspective view of the liquid application unit;

DETAILED DESCRIPTION OF THEPREFERRED EMBODIMENTS

To describe the present invention, preferred embodiments of the present invention will be described below with reference to the drawings.

Figure 3:
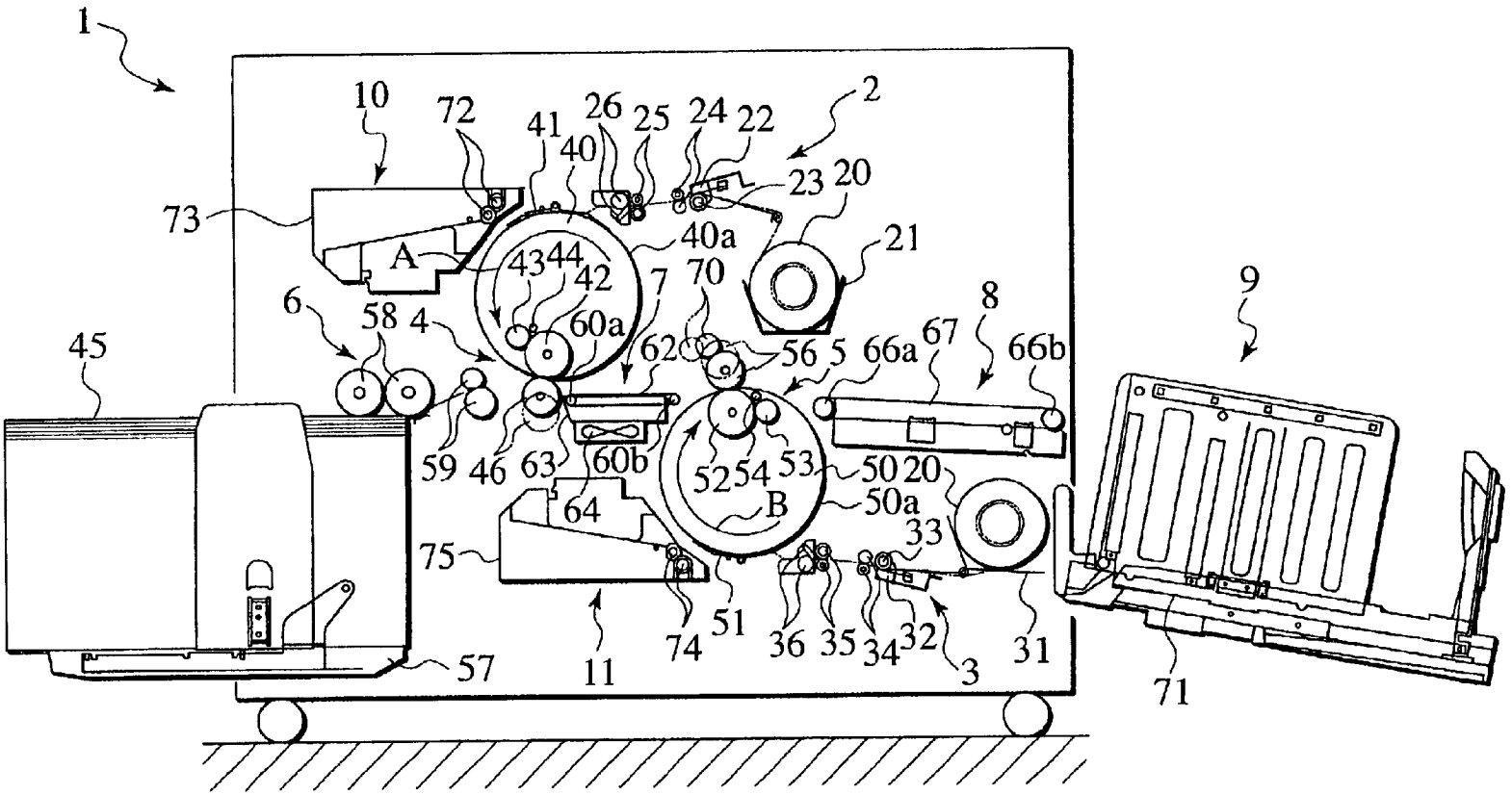
FIG. 3 is a schematic structural view of a stencil printing machine of a preferred embodiment according to the present invention.

FIG. 3 shows a schematic whole structural view of a stencil printing machine of first to third preferred embodiments according to the present invention, and a common structure of the first to third preferred embodiments is described below with reference to FIG. 3.

As shown in FIG. 3, the digital type stencil printing machine 1 is mainly constructed of an original read out section which is not shown, an upstream stencil making section 2, a downstream stencil making section 3, an upstream printing section 4, a downstream printing section 5, a paper feed section 6, an upstream belt transfer unit 7, a downstream belt transfer unit 8, a sheet discharge section 9, an upstream stencil disposal section 10 and a downstream stencil disposal section 11.

The original read out section includes, for example, an automatic paper feed and read out unit. The automatic paper feed and read out unit is constructed of an inclined original resting plate to allow the original to be rested, an original feed roller pair for transferring the original resting on the inclined original resting plate, and a line image sensor for obtaining image data by converting contents of the original, which is transferred, to a train of electric signals. The line image sensor is commonly used as that of the original positioning and read out unit.

The original positioning and read out unit includes a horizontal original positioning glass table for allowing the original to be positioned, a pressure plate located on the horizontal original positioning glass table for free opening and closing capabilities, a guide belt located in an area below the horizontal original positioning glass plate to be moveable with a drive force of a pulse motor, and the line image sensor which is guided with the guide belt to move in the area below the original positioning glass plate.

Further, the line image sensor of the automatic paper feed and read out unit reads out the original which is transferred with the original feed roller pair. In the original positioning and read out unit, the line image sensor is guided and moved with the guide belt to scan a lower surface of the original to read out the contents of the original.

The upstream stencil making section 2 includes a stencil sheet receiving tray 21 which receives an elongated stencil sheet 20 in the form of a roll, a thermal printing head 22 composed of a writing head which is located at a position downstream of the stencil sheet receiving tray 21 in a transfer direction of the stencil sheet 20 relative to the stencil sheet receiving tray 21, a platen roller 23 located in opposed relation to the thermal printing head 22 and driven by a pulse motor (not shown), a stencil feed roller pair 24 located downstream of the thermal printing head 22 and the platen roller 23 in the transfer direction of the stencil sheet 20 and rotated with the drive force of the pulse motor (not shown), a stencil feed roller pair 25 located further downstream of the stencil feed roller pair 24 in the transfer direction of the stencil sheet, and a stencil cutter 26 located downstream of the stencil feed roller pair 25. The thermal printing head 22 includes a plurality of dot-shaped thermal elements located, in a plane perpendicular to the transfer direction of the stencil sheet 20, to occupy a space in a range equal to a paper size of A3 to meet the maximum size A3 of a print sheet which is intended in the preferred embodiment.

In addition, rotations of the platen roller 23 and the stencil feed roller pair 24 allow the stencil sheet 20 to be transferred. During such transfer of the stencil sheet 20, the dot-shaped thermal elements of the thermal printing head 22 are selectively activated to produce heat on the basis of image data, which corresponds to an upper surface (one surface) of the original, read out with the line image sensor to permit thermal perforation in the stencil sheet 20 to form a desired perforated area, with a trailing edge of the stencil sheet 20, which has the desired perforated area, being cut with the stencil cutter 26 to form a perforated stencil sheet 20 of a given length.

The downstream stencil making section 3 includes a stencil sheet receiving tray 3 which receives an elongated stencil sheet 20 in the form of a roll, a thermal printing head 32 composed of a writing head which is located at a position downstream of the stencil sheet receiving tray 3 in a transfer direction of the stencil sheet 20 relative to the stencil sheet receiving tray 3, a platen roller 33 located in opposed relation to the thermal printing head 32 and driven by a pulse motor which is not shown, a stencil feed roller pair 34 located downstream of the thermal printing head 32 and the platen roller 33 in the transfer direction of the stencil sheet 20 and rotated with the drive force of the pulse motor which is not shown, a stencil feed roller pair 35 located further downstream of the stencil feed roller pair 34 in the transfer direction of the stencil sheet, and a stencil cutter 36 located downstream of the stencil feed roller pair 35. The thermal printing head 32 includes a plurality of dot-shaped thermal elements located, in a plane perpendicular to the transfer direction of the stencil sheet 20, to occupy a space in a range equal to a paper size of A3 to meet the maximum size A3 of a print sheet which is intended in the preferred embodiment.

In addition, rotations of the platen roller 33 and the stencil feed roller pair 34 allow the stencil sheet 20 to be transferred. During such transfer of the stencil sheet 20, the dot-shaped thermal elements of the thermal printing head 32 are selectively activated to produce heat on the basis of image data, which corresponds to a lower surface (the other surface) of the original, read out with the line image sensor to permit thermal perforation in the stencil sheet 20 to form a desired perforated area, with a trailing edge of the stencil sheet 20, which has the desired perforated area, being cut with the stencil cutter 36 to form a perforated stencil sheet 20 of a given length.

The upstream printing section 4 is constructed of an upstream printing drum 40 which includes an outer peripheral wall 40*a*, which is composed of an ink permeable member formed in a perforated structure, and which rotates in a direction as shown by an arrow A in FIG. 3 with a drive force of a main motor which is not shown in FIG. 3, and a stencil clamping segment 41 mounted to the outer periphery

40*a* of the printing drum 40 for clamping a leading edge of the stencil sheet 20.

Further, the upstream printing section 4 includes a squeegee roller 42 located inside the outer peripheral wall 40*a* and held in contact with an inner peripheral surface of the outer peripheral wall 40*a*, a doctor roller 43 spaced from the squeeze roller 42 with a given gap and an ink supply unit 44 for supplying ink to an area between the rollers 42, 43, a press roller 46 which is located in an area outside the printing drum 40 in opposed relation to the squeeze roller 42 via the outer peripheral wall 40*a* thereof and which serves as a rotating press member, and a pressure exerting unit (not shown) which selectively moves the press roller 46 into a pressured engagement position (a position as indicated by a solid line in FIG. 3) to urge the press roller 46 against the outer peripheral wall 40*a* of the printing drum 40, and a separated position (a position indicated by a phantom line in FIG. 3) to separate the press roller 46 from the outer peripheral wall 40*a* of the printing drum 40. The press roller 46 functions to move between the pressured engagement position and the separated position in association with rotation of the printing drum 40 during the printing operation such that, during transit of the print sheet 45, which serves as print medium, transferred in synchronism with rotation of the printing drum 40, the press roller 46 remains in the pressured engagement position and, during other operating phase (i.e., during non-transit phase of the print sheet 45), the press roller 46 remains in the separated position.

With such a structure, clamping the leading edge of the stencil sheet 20, which is transferred from the upstream stencil making section 2, with the stencil clamping segment 41, while permitting rotation of the printing drum 40 under the clamped state of the stencil sheet 20 allows the stencil sheet 20 to be wound around and mounted to the outer periphery 40*a* of the printing drum 40. When this occurs, the print sheet 45, which is transferred in synchronism with the rotation of the printing drum 40, is brought into pressured contact with the stencil sheet 20 of the printing drum 40 with the action of the press roller 46, allowing ink to be transferred through the perforated area of the stencil sheet 20 onto the upper surface (the one surface) of the print sheet 45 to reproduce a desired image thereon.

The downstream printing section 5 is constructed of a downstream printing drum 50 that includes an outer peripheral wall 50*a* composed of an ink permeable member formed in a perforated structure and that rotates in a direction as shown by an arrow B in FIG. 3 with a drive force of a main motor which is not shown, and a stencil clamping segment 51 mounted to the outer periphery 50*a* of the printing drum 50 for clamping a leading edge of the stencil sheet 20.

Further, the upstream printing section 5 includes a squeegee roller 52 located inside the outer peripheral wall 50*a* and held in contact with an inner peripheral surface of the outer peripheral wall 50*a*, a doctor roller 53 spaced from the squeeze roller 52 with a given gap, an ink supply unit 54 for supplying ink to an area between the rollers 52, 53, a downstream press roller 56 which is located in an area outside the printing drum 50 in opposed relation to the squeeze roller 52 via the outer peripheral wall 50*a* thereof and which serves as a rotary press member, a pressure exerting unit (not shown) which selectively moves the press roller 56 into a separated position (a position as indicated by a solid line in FIG. 3) to urge the press roller 56 against the outer peripheral wall 50*a* of the printing drum 50 and a pressured position (a position indicated by a phantom line in FIG. 3) to separate the press roller 56 from the outer peripheral wall 50*a* of the printing drum 50, and a liquid application roller (a liquid application unit) 70 which enables application of silicone oil, which is liquid, to an outer periphery of the press roller 56. The press roller 56 functions to move between the pressured engagement position and the separated position in association with rotation of the printing drum 50 during the printing operation such that, during transit phase of the print sheet 45, which serves as print medium, transferred in synchronism with rotation of the printing drum 50, the press roller 56 remains in the pressured engagement position and, during other operating phase (i.e., during non-transit phase of the print sheet 45), the press roller 56 remains in the separated position. The liquid application roller 70 may be associated with the press roller 56 so as to rotate therewith, or may be located (in a fixed state) so as to interrupt rotation with the press roller 56.

With such a structure, clamping the leading edge of the stencil sheet 20, which is transferred from the upstream stencil making section 3, with the clamping base 51, while permitting rotation of the printing drum 50 under the clamped state of the stencil sheet 20 allows the stencil sheet 20 to be wound around and mounted to the outer periphery 50*a* of the printing drum 50. When this occurs, the print sheet 45, which is transferred in synchronism with the rotation of the printing drum 50, is brought into pressured contact with the stencil sheet 20 of the printing drum 50 with the action of the press roller 56, allowing ink to be transferred through the perforated area of the stencil sheet onto the lower surface (the other one surface) of the print sheet 45 to reproduce a desired image thereon.

The paper feed section 6 is constructed of a paper feed tray 57 on which a stack of the print sheets 45, which serve as printing media, is placed, a primary paper feed roller pair 58 for moving only one print sheet 45 from the uppermost position of the stack of the print sheets 45 in the paper feed tray 57, and a secondary paper feed roller pair 59 for transferring the print sheet 45, which is transferred with the paper feed roller pair 58, to an area between the printing drum 40 and the press roller 46 in synchronism with the rotation of the upstream printing drum 40. The primary and secondary paper feed roller pairs 58, 59 are so arranged as to be selectively applied with the drive force of the main motor by means of respective paper feed clutches which is not shown.

The upstream belt-conveyer transfer unit 7, which serves as the upstream transfer mechanism, functions to receive the print sheet 45 discharged from the upstream printing section 4 to transfer the received print sheet 45 to an area in front of the downstream printing section 5 to be fed thereto. The upstream belt-conveyer transfer unit 7 includes a pair of belt stretching members 60*a*, 60*b*, a belt 62 stretched between the pair of belt stretching members 60*a*, 60*b*, an intake box 63 and an intake fan 64 for sucking the leading edge of the print sheet 45 transferred on the belt 62, and a belt drive unit which is not shown to drive the belt 62 for rotating movement of the belt stretching member 60*a* (or 60*b*). Further, the upstream belt-conveyer transfer unit 7 functions to suck the print sheet 45 to transfer the print sheet 45 due to the movement of the belt 62 per se under a condition that the surface of the print sheet 45 opposed to the previously printed surface is held in contact with the belt 62.

The downstream belt-conveyer transfer unit (the upstream transfer unit) 8 function to receive the print sheet 45 discharged from the downstream printing section 5 to transfer the received print sheet 45 to the sheet discharge section 9. The downstream belt-conveyer transfer unit 8 includes a pair of pulleys 66*a*, 66*b*, a belt 67 stretched between the pair of pulleys 60*a*, 60*b*, an intake box and an intake fan, both of which are not shown, for sucking the leading edge of the print sheet 45 transferred on the belt 67, and a belt drive unit (not shown) to drive the belt 67 for rotating movement of the pulley 66*a* (or 66*b*). Further, the downstream belt-conveyer transfer unit 8 functions to suck the print sheet 45 to transfer the print sheet 45 due to the movement of the belt 67 per se.

The sheet discharge section 9 includes a paper receiving tray 71 located in a drop area of the print sheet 45 for allowing the print sheet 45, which has been printed and is transferred with the downstream belt-conveyer transfer mechanism 8, to be placed in a stacked state.

The upstream stencil disposal section 10 includes a stencil separating roller pair 72 for receiving the leading edge of the stencil sheet 20, which has been previously wound on the upstream printing drum 40 with the leading edge being released from the upstream printing drum 40, and for transferring the stencil sheet 20, whose clamped state is released, while peeling off the same from the upstream printing drum 40, and a stencil disposal box 73 for receiving the stencil sheet 20 which is transferred with the stencil separating roller pair 72.

The downstream stencil disposal section 11 includes a stencil separating roller pair 74 for receiving the leading edge of the stencil sheet 20, which has been previously wound on the downstream printing drum 50 with the leading edge being released from the downstream printing drum 50, and for transferring the stencil sheet 20, whose clamped state is released, while peeling off the same from the downstream printing drum 50, and a stencil disposal box 75 for receiving the stencil sheet 20 which is transferred with the stencil separating roller pair 74.

The structure described above is common to the first to third preferred embodiments, and the first to third preferred embodiments of the digital type stencil printing machine of the present invention will be described below in detail in conjunction with structures which are different from each other.

Figure 8:
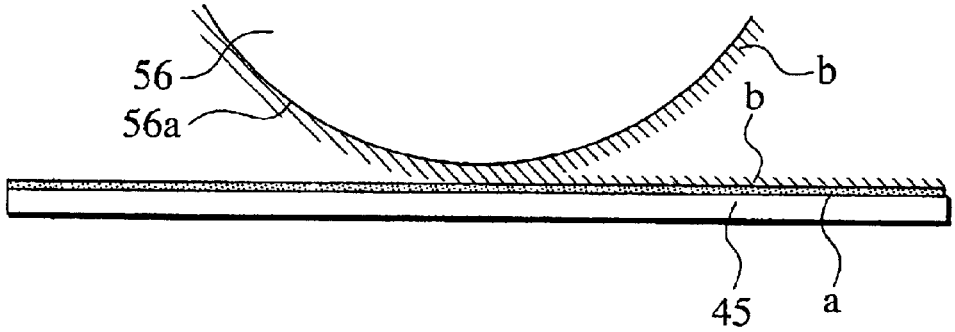
FIG. 8 is a view for illustrating a condition wherein during the separating movement of the press roller and the print sheet, silicone oil applied to the press roller is split and separated.

In the first preferred embodiment, as shown in FIG. 8, an outer circumferential periphery 56*a* of the downstream press roller 56 has micro-convexities and concavities which are not shown and the outer circumferential periphery 56*a* of the press roller 56 is not applied with silicone oil from the liquid application roller 70. The micro-convexities and concavities of the outer circumferential periphery 56*a* of the press roller 56 is formed by mounting a mesh screen, made of polyester, with distances between adjacent apexes of the micro-convexities and concavities and depths of the same being varied as seen in FIG. 4.

Here, an intersecting point between fibers of the polyester mesh screen is regarded as the apex of the convexities and the concavities. Distance data between the adjacent apexes is indicated with a calculated value obtained by calculating the mesh number of the polyester mesh screen, and depth data of the convexities and the concavities is indicated with an experimental result by measuring a difference in level between the warp and the woof of the fabric with a contact type surface roughness meter. The reason why the depth of the convexities and the concavities is actually measured in the above method is described below. When using the polyester mesh screen, there are some instances wherein the mesh screen is hardly protected from contamination due to an inherent structure thereof. When an adequate protection effect is obtained, a non-fixed ink area of the print sheet is brought into contact only with the intersecting point area of the fabric corresponding to the apex area of the convexities and the concavities. When this occurs, if the non-fixed ink area is brought into contact with other areas than the intersecting point area of the fabric with a small difference in level between the warp and the woof of the fabric at the intersecting area, it is difficult for the mesh screen to have the contamination protecting effect. For this reason, the difference in level of the warp and the woof at the intersecting point of the fabric is regarded as the depth of the convexities and the concavities. This is also applied in the second and third preferred embodiments which will be discussed later.

In the second preferred embodiment, the outer circumferential periphery 56*a* of the downstream press roller 56 has the micro-convexities and concavities which are not shown and the outer circumferential periphery 56*a* of the press roller 56 is slightly applied with the silicone oil with a certain viscosity from the liquid application roller 70. The convexities and the concavities of the outer circumferential periphery 56*a* of the press roller 56 are formed by mounting the mesh screen, made of polyester, which is selected from a number of mesh sizes with different distances between adjacent apexes of the convexities and the concavities and different depths of the convexities and the concavities with a fixed level in the viscosity of silicone oil as seen in FIG. 5.

In the third preferred embodiment, the outer circumferential periphery 56*a* of the downstream press roller 56 has the micro-convexities and concavities which are not shown and the outer circumferential periphery 56*a* of the press roller 56 is applied with the silicone oil from the liquid application roller 70. The convexities and the concavities of the outer circumferential periphery 56*a* of the press roller 56 is formed by mounting the mesh screen, made of polyester, with fixed values in distances between adjacent apexes of the convexities and the concavities and in depths of the convexities and the concavities while the viscosity of silicone oil has different values as seen in FIG. 6.

In a comparison (in prior art), further, the downstream press roller 56 is made of natural rubber material and has an outer circumferential surface formed with a flat surface without the micro-convexities and concavities as seen in FIG. 7, and the press roller 56 is not applied with liquid such as silicone oil from the liquid application roller 70.

Now, the stencil making operation and the printing operation of the aforementioned stencil printing machine 1 is described. When a stencil making mode is selected, the controller checks whether the stencil sheets 20 are wound on respective printing drums 40,50, and in the presence of the stencil sheets 20 over the printing drums, the controller allows the stencil sheets 20 to be removed from the respective printing drums 40,50 to discharge them in the stencil disposal boxes 73, 75, respectively.

Upon completion of the stencil disposal step, the stencil sheet 20 is thermally perforated with the thermal printing head 22 on the basis of image data correlated with an upper surface side read out by the original read out operation. Then, a mounting step is carried out for mounting the stencil sheet 20, which is made, onto the upstream side printing drum 40, thereby terminating the stencil making operation at the upstream side. Likewise, the stencil sheet 20 is also thermally perforated with the thermal printing head 32 on the basis of image data correlated with a lower surface side read out by the original read out operation. Then, a mounting step is carried out for mounting the stencil sheet 20, which is made, onto the downstream side printing drum 50, thereby terminating the stencil making operation at the downstream side.

Next, when selecting the printing mode, the operator checks whether the print sheet 45 remains on the paper feed tray 57, and in the absence of the print sheet 45, the controller carries out the non-print sheet error correction. Further, the controller checks whether the stencil sheets 20 are wound on the respective printing drums 40, 50 and in the absence of the stencil sheets 20, the controller carries out the non-stencil sheet error correction. Also, the controller checks whether ink remains in the ink traps between the squeeze rollers 42, 52 and between the doctor rollers 43, 53, and in the absence of ink, the controller performs the non-ink error correction.

When clearing all the check items, the main motor is driven to rotate the respective printing drums 40, 50, causing the print sheet 45 to be fed to the printing drum 40 at the upstream side from the paper feed section 6 in synchronism with the rotation of the main motor. The print sheet 45, thus fed to the printing drum 40, is urged toward the stencil sheet 20 of the printing drum 40 by means of the press roller 46 to allow ink image to be transferred to the upper surface of the print sheet 45. The print sheet 45, thus printed at its upper surface, is peeled off from the outer circumferential periphery of the printing drum 40 and is guided to the upstream belt transfer mechanism 7. The upstream belt transfer mechanism 7 transfers the print sheet 45 with its lower surface held in contact with the belt 62 to allow the print sheet 45 to the downstream printing drum 50from the downstream site of the belt 62. The print sheet 45 is then urged toward the stencil sheet 20 of the printing drum 50 with the press roller 56 via the belt 67 to allow ink image to be transferred to the lower surface of the print sheet 45. The print sheet 45, whose lower surface is printed, is peeled off from the outer circumferential periphery of the printing drum 50 and is guided to the downstream belt transfer mechanism 8. The downstream belt transfer mechanism 8 allows the print sheet 45 to be transferred with the belt 67, thereby discharging the print sheet 45 to be discharged to the sheet discharge tray 71. The print sheet 45 discharged into the sheet discharge tray 71 is accumulated here in stacked form.

The double-face printing operation has been carried out in conjunction with the first to third preferred embodiments and the comparison to obtain experimental results shown in FIGS. 4 to 7 in terms of the contaminated status of the print sheet 45 and the press roller 56 and an image quality of the lower surface of the print sheet 45. In FIGS. 4 to 7, a visual evaluation standard for the contaminated status involves ◎: an event wherein no-contamination on the print sheet 45 and ink is hardly adhered to the outer circumferential periphery 56*a* of the press roller 56, ○: an event wherein although the print sheet 45 has a little contamination, the outer circumferential periphery 56*a* of the press roller 56 is slightly adhered with ink, Δ: an event wherein the print sheet 45 has a slight contamination, and x: an event wherein the print sheet 45 is considerably contaminated. The visual evaluation standard for the image quality at the lower surface of the print sheet 45 involves ○: an event wherein beautiful print is carried out in uniform state, and x: an event wherein a convexity and concavity pattern of the press roller 56 is confirmed.

An evaluation result between the first preferred embodiment and the comparison reveals an improvement in the contaminated status because of the provision of the micro-convexities and concavities formed over the outer circumferential periphery 56*a* of the press roller 56. That is, forming the tiny unevenness over the outer circumferential periphery 56*a* of the press roller 56 results in a minimized contact area between the outer circumferential periphery 56*a* of the press roller 56 and a non-fixed ink surface of the print sheet 45 to avoid the press roller 56 from being adhered with non-fixed ink at an area corresponding to a portion wherein the press roller 56 remains out of contact when the press roller 56 is separated from the print sheet 45. For this reason, it seems that non-fixed ink is not appreciably adhered to the press roller 56 and, therefore, the contamination of the print sheet 45 is avoided with a little decrease in a print density of the print sheet. Also, the contamination of the print sheet 45 can be prevented with the provision of mere micro-convexities and concavities formed over the outer circumferential periphery 56*a* of the press roller 556, with a resultant capability in preventing the contamination with a simplified structure. It will thus be seen that it is possible for the stencil printing machine to prevent the print sheet from being contaminated with the little reduction in the print density of the print sheet 45 in the simplified structure.

In view of the evaluation result of the first preferred embodiment, further, it is possible to appreciably preclude the contamination of the print sheet 45 (as evaluated as ○ in the contaminated status) with the uneven surface having a value beyond the order of 0.035 mm in depth, of the outer circumferential periphery 56*a* of the press roller 56. That is, when the press roller 56 urges the printing drum 50 via the print sheet 45, the outer circumferential periphery 56*a* of the press roller 56 has an increased difference in level of the convexities and the concavities of the outer circumferential periphery 56*a* of the press roller 56 such that the convex portion of the convex and concave area is precluded to be hardly held in contact with the non-fixed ink of the print sheet 45. When this occurs, since a level of transfer of non-fixed ink relative to the press roller 56 can be adequately minimized, it appears that a visible contamination of the print sheet 45 is reliably precluded.

In view of the evaluation result of the second preferred embodiment, further, it is possible to appreciably preclude the contamination of the print sheet 45 (as evaluated as ◎ in the contaminated status) with the convexities and the concavities having a value beyond the order of 0.044 mm in depth, of the outer circumferential periphery 56*a* of the press roller 56. That is, when the press roller 56 urges the printing drum 50 via the print sheet 45, the outer circumferential periphery 56*a* of the press roller 56 has an appreciably increased difference in level of the convexities and the concavities of the outer circumferential periphery 56*a* of the press roller 56 such that the convex portion of the convex and concave area has little or no contact with the non-fixed ink area of the print sheet 45. When this occurs, since a level of transfer of non-fixed ink relative to the press roller 56 can be adequately minimized, it appears that a visible contamination of the print sheet 45 is more reliably precluded.

In view of the evaluation results of the first and second preferred embodiments, it is possible for the print sheet 45 to be printed in a uniform and beautiful fashion at the rear side (as evaluated as ○ in the image quality) with the convexities and the concavities having a value below the order of 0.64 mm in the distance between the adjacent apexes, of the outer circumferential periphery 56*a* of the press roller 56. That is, when the press roller 56 urges the printing drum 50 via the print sheet 45, the outer circumferential periphery 56*a* of the press roller 56 has a narrow space between the adjacent apexes in the convex and concave area of the outer circumferential periphery 56*a* of the press roller 56 such that a visible uneven pattern does not appear on the print image. For this reason, it is thought that a high quality image is obtained.

In view of the evaluation result of the second preferred embodiment, application of silicone oil over the outer circumferential periphery 56*a* of the press roller 56 has an effect for precluding the contamination of the print sheet 45. That is, as shown in FIG. 8, when the press roller 56 and the print sheet 45 are separated from one another, the non-fixed ink portion a is not ripped and the liquid portion b is ripped, precluding the press roller 56 from being adhered with the non-fixed ink a to prevent the contamination of the print sheet 45 in a substantially complete fashion.

In view of the evaluation result of the third preferred embodiment, if silicone oil with the viscosity in the order below 1000 millipascal·second (mPa·s) is used, the print sheet 45 can be hardly contaminated (as evaluated as ○ in the contaminated status). That is, it is thought that when the press roller 56 and the print sheet 45 are separated from one another, liquid is reliably split at a low viscosity liquid portion for preventing non-fixed ink from being adhered to the press roller 56 to completely preclude the contamination of the print sheet 45.

In view of the evaluation result of the third preferred embodiment, if silicone oil with the viscosity in the order below 500 millipascal·second (mPa·s) is used, the contamination of the print sheet can be precluded (as evaluated as ◎ in the contaminated status). That is, it is thought that when the press roller 56 and the print sheet 45 are separated from one another, liquid is more reliably split at a lower viscosity liquid portion for preventing non-fixed ink from being adhered to the press roller 56 to further completely preclude the contamination of the print sheet 45.

To summarize the evaluation results of the first to third preferred embodiments, it is preferably advisable that the uneven surface of the outer circumferential periphery 56*a* of the press roller 56 has the space between the adjacent apexes in a value ranging from 0.10 to 0.64 mm, the depth in a value ranging from 0.035 (preferably 0.044) to 0.20 mm and the press roller 56 is preferably applied with silicone oil with the density in a value below 500 millipascal·second.

Figure 1:
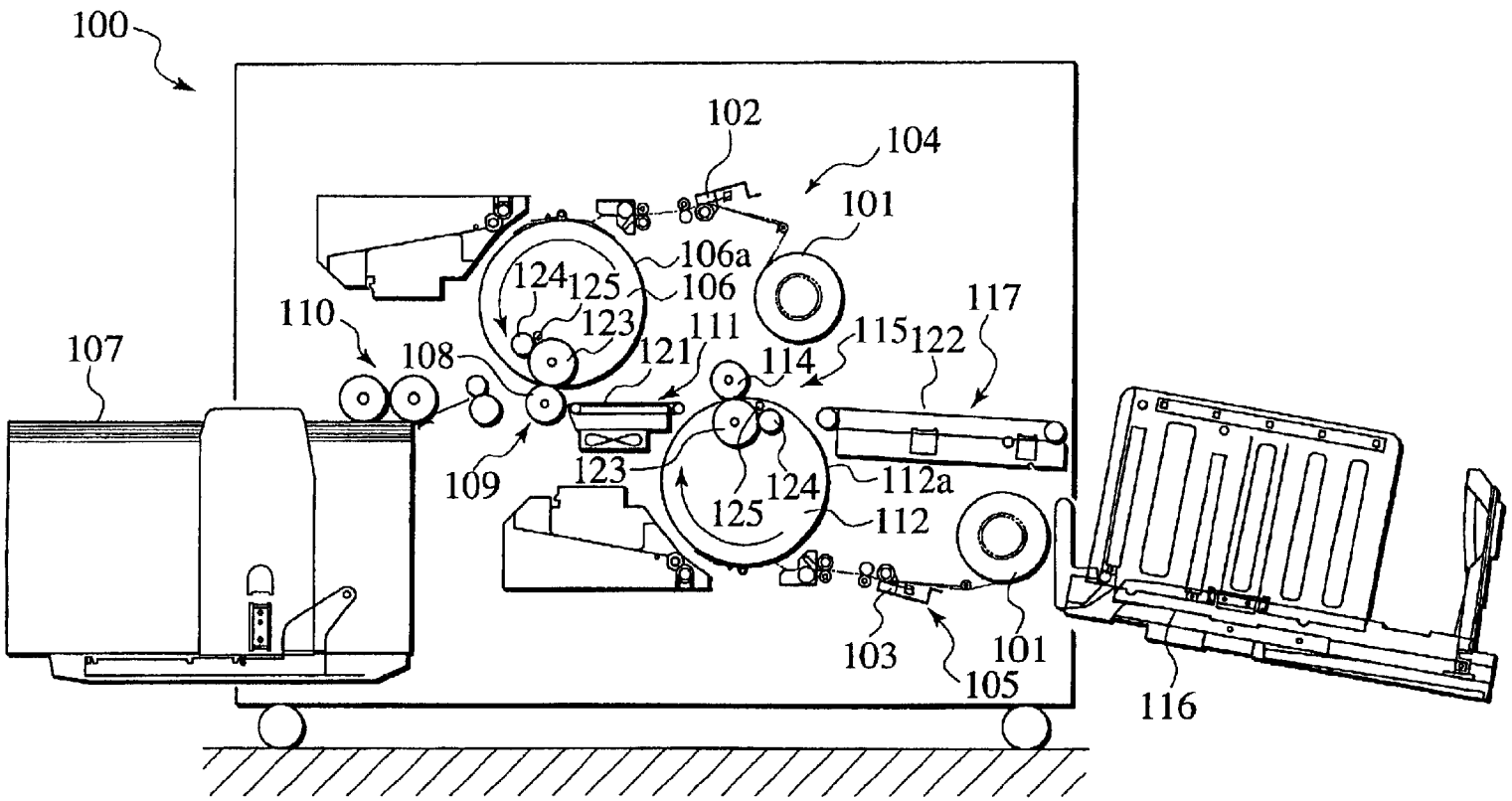
FIG. 1 is a schematic structural view of a stencil printing machine of a prior art.
Figure 2:
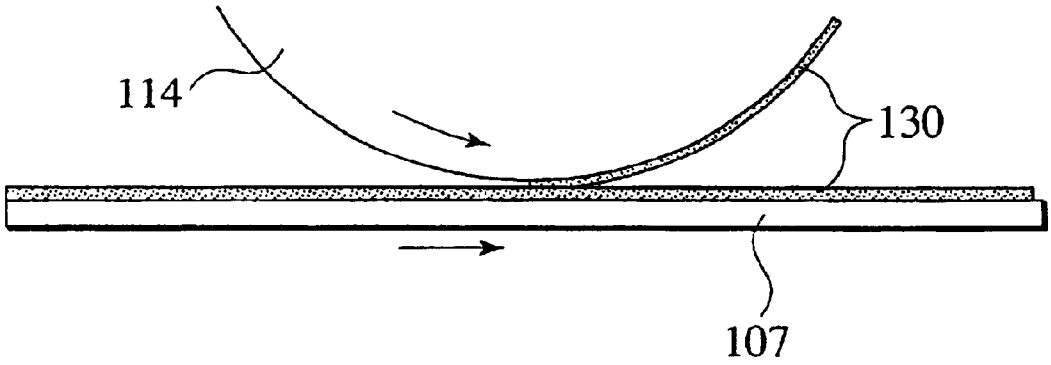
FIG. 2 is a view for illustrating a condition experienced in the prior art wherein during a separating movement of a press roller and a print sheet, a non-fixed ink area is split to cause ink to be transferred to the press roller.

Now, a detailed description will be given to fourth to ninth preferred embodiments of the present invention. Overall structures of the stencil printing machines are identical with those of the structures of the first to third preferred embodiments commonly shown in FIG. 1 and, therefore, a detailed description of the same is herein omitted except for component parts which are different from those of the first to third preferred embodiments.

In the fourth and fifth preferred embodiments, micro-convexities and concavities formed over the outer circumferential periphery 56*a* of the downstream press roller 56 have respective detailed structures discussed below.

Figure 9:
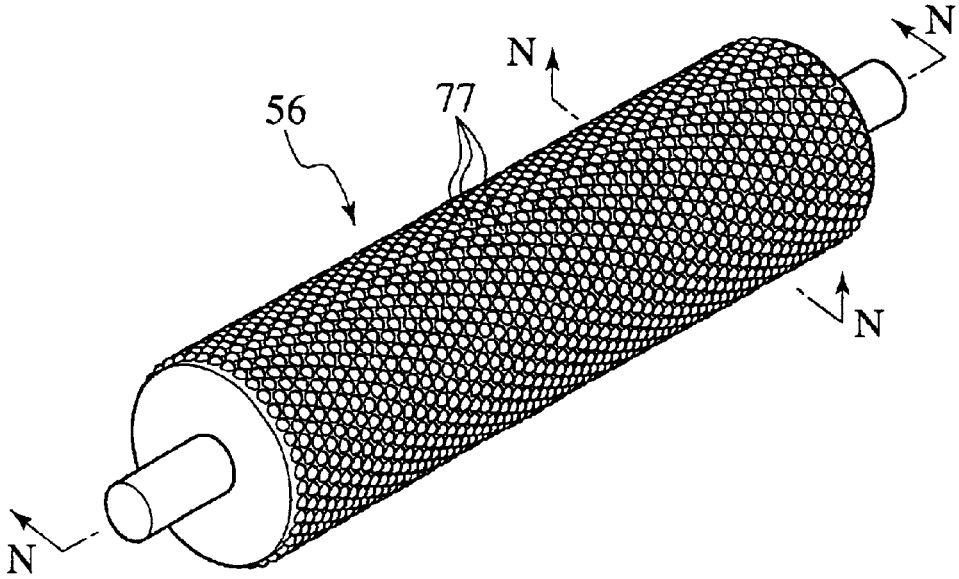
FIG. 9 is a perspective view of a press roller of a fourth preferred embodiment according to the present invention.
Figure 10:
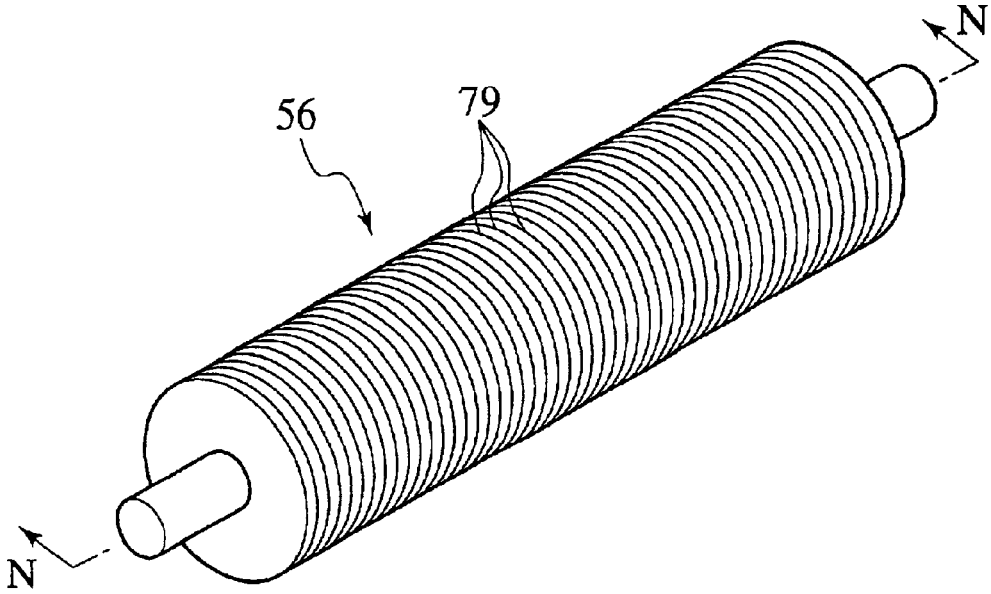
FIG. 10 is a perspective view of a press roller of a fifth preferred embodiment according to the present invention.

The micro-convexities and concavities of the fourth preferred embodiment shown in FIG. 9 are formed of point-like micro-convexities and concavities composed of a large number of point-like segments 77 located on the outer circumferential periphery 56*a*. The micro-convexities and concavities of the fifth preferred embodiment shown in FIG. 10 are formed of line-shaped micro-convexities and concavities composed of a large number of line-shaped segments 79 located on the outer circumferential periphery 56*a*. The respective line-shaped protrusions 79 are orientated in a circumferential direction of the press roller 56, i.e. in the same direction (a direction perpendicular to an axial direction of the press roller 56) as that which the print sheet 45 is transferred.

Figure 11:
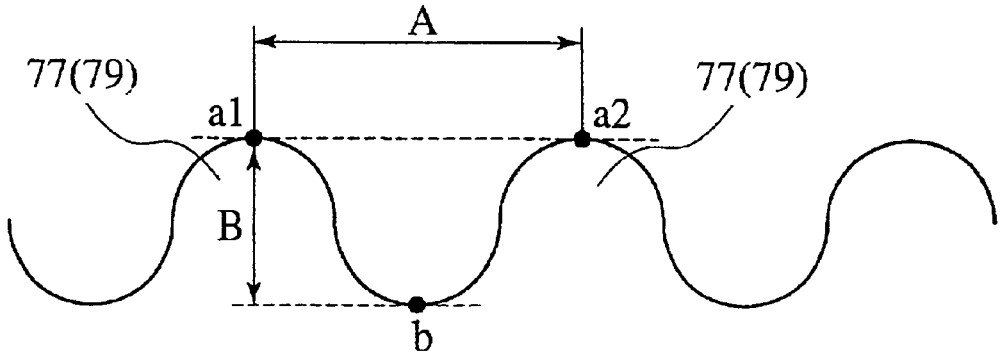
FIG. 11 is a typical view for illustrating a difference in level of the convexities and the concavities of the press rollers in the fourth and fifth preferred embodiments of the present invention.

FIG. 11 is an enlarged typical view illustrating the point-like segments 77 and the line-shaped segments 79 as viewed along respective lines N—N of FIGS. 9 and 10. As shown in FIG. 11, assuming that the distance between the apexes a1 and a2 of the point-like segments 77 or the line-shaped segments 79 is represented with A, the height between the apex a1 (or the apex a2) and the lowest bottom wall b, i.e., the depth of the convexities and the concavities, is represented with B, the dimensions A and B correspond to the dimensions described with reference to the first to third preferred embodiments. In particular, the dimension A, which corresponds to the distance between the adjacent convexities and concavities, is preferably designed to be in a range below 0.64 mm. The dimension B, which corresponds to the depth between the convexities and the concavities, is preferably designed to be in a range above 0.035 mm and more preferably in a range above 0.045 mm.

In the fourth preferred embodiment, the presence of the convexities and the concavities are substantially equally distributed in any direction over the outer circumferential periphery 56*a* of the press roller 56 substantially evenly enables protection of ink transfer in every directions.

In the fifth preferred embodiment, the presence of the line-shaped convexities and concavities, which are formed over the outer circumferential periphery 56*a* of the press roller 56 on a regular basis in the same direction as that which the print sheet 45 is transferred, ensures preclusion of ink transfer that would otherwise occur in a direction perpendicular to the axial direction of the press roller 56.

Although the line-shaped segments 79 of the fifth preferred embodiment are orientated in the same direction as that which the print sheet 45 is transferred, the line-shaped segments 79 may be orientated in a spiral direction or may be orientated at an inclined angle with respect to the transfer direction of the print sheet 45 in either direction. Further, the presence of the line-shaped segments 79 formed in either direction enables preclusion of ink transfer with respect to the direction perpendicular to that the line-shaped segments 79 are orientated in a reliable manner.

Figure 12A:
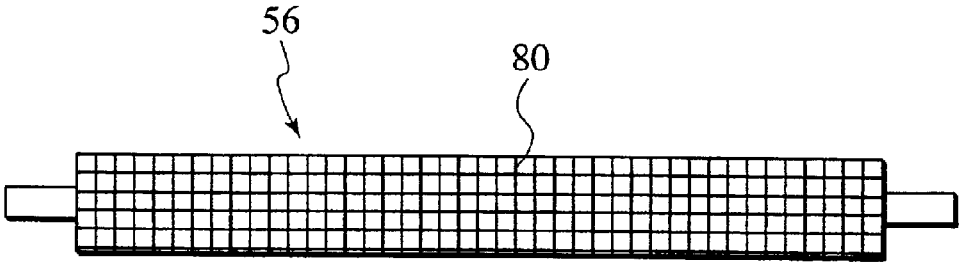
Figure 12B:
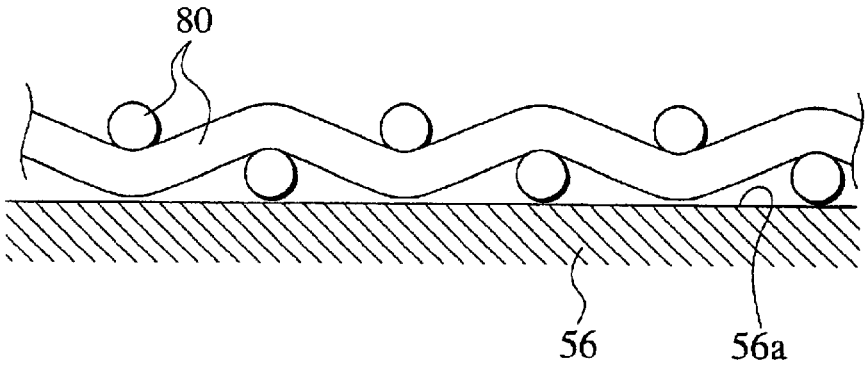
Figure 13A:
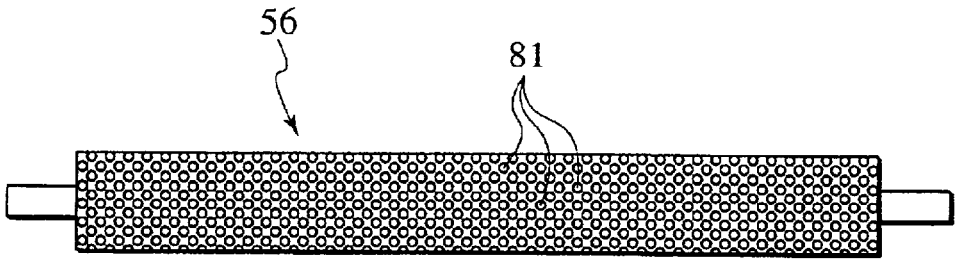
Figure 13B:
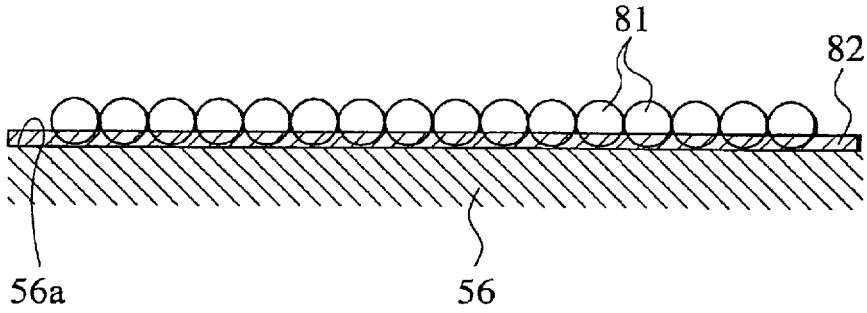

The point-like convexities and concavities of the fourth preferred embodiment is actually formed by a process shown in FIGS. 12A and 12B and a process shown in FIGS. 13A and 13B.

In FIGS. 12A and 12B, the point-like convexities and concavities are formed by covering the outer circumferential periphery 56*a* of the press roller 56 with a cylindrical screen mesh 80 or by adhering the screen mesh 80 to the outer circumferential periphery 56*a* of the press roller 56. That is, this structure corresponds to those used in the first to third preferred embodiments. In FIGS. 13A and 13B, the point-like convexities and concavities are formed by adhering a large number of spherical bodies 81, serving as the point-like segments, to the outer circumferential periphery 56*a* of the press roller 56 by means of adhesive material 82.

The detailed example shown in FIGS. 12A and 12B enables the formation of the micro-convexities and concavities by preparing the screen mesh 80 per se separately from the press roller 56 and subsequently locating the screen mesh onto the outer circumferential periphery 56*a* of the press roller 56 in a covering method or in the adhering method, providing an ease of formation of the point-like convexities and concavities.

The detailed example shown in FIGS. 13A and 13B enables the formation of the micro-convexities and concavities by preparing the large number of spherical bodies 81 per se separately from the press roller 56 and subsequently locating the spherical bodies onto the outer circumferential periphery 56*a* of the press roller 56 in the adhering method, providing an ease of formation of the point-like convexities and concavities.

In the sixth to ninth preferred embodiments, the liquid application units for applying liquid to the outer circumferential periphery 56*a* of the downstream press roller 56 have detailed structures which are constructed in a manner described below.

Figure 14A:
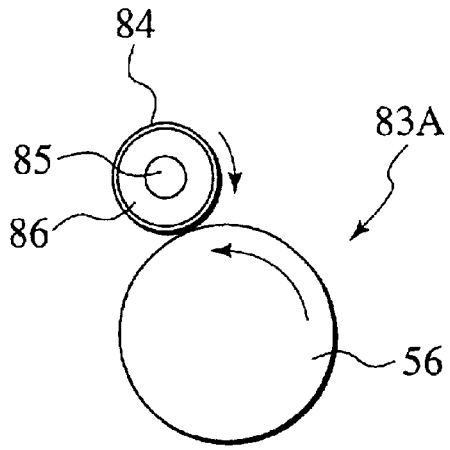
Figure 14B:
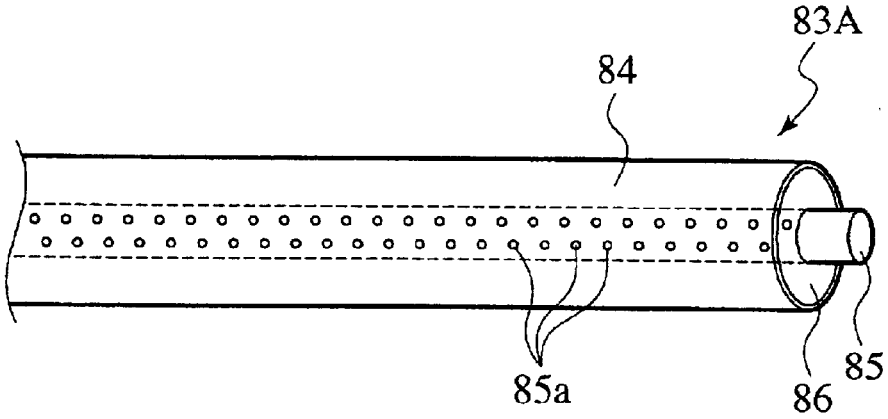

The liquid application unit 83A of the sixth preferred embodiment shown in FIGS. 14A and 14B is constructed of a liquid application roller 84 held in pressured contact with the press roller 56 for rotating movement, a liquid supply pipe 85 concentrically located in an inner peripheral position of the liquid application roller 84 and internally filled with liquid, and a porous sheet 86 such as a nonwoven fabric, etc. interposed between the outer periphery of the liquid supply pipe 85 and the inner periphery of the liquid application roller 84. The liquid supply pipe 85 is formed with a large number of apertures 85*a* through which liquid in the liquid supply pipe 85 flows to permeate into the porous sheet 86, with permeated liquid being fed to the outer periphery of the liquid application roller 84. Thus, the liquid supply pipe 85 and the porous sheet 86 forms a liquid supply section.

With such a sixth preferred embodiment, the liquid application roller 84 rotates with the press roller 56 to apply liquid onto the press roller 56, making it possible to apply liquid to the press roller 56 with little rotational load. Also, the presence of a structure to rotate the liquid application roller 84 substantially completely eliminates the rotational load to be exerted to the press roller 56.

Figure 15:
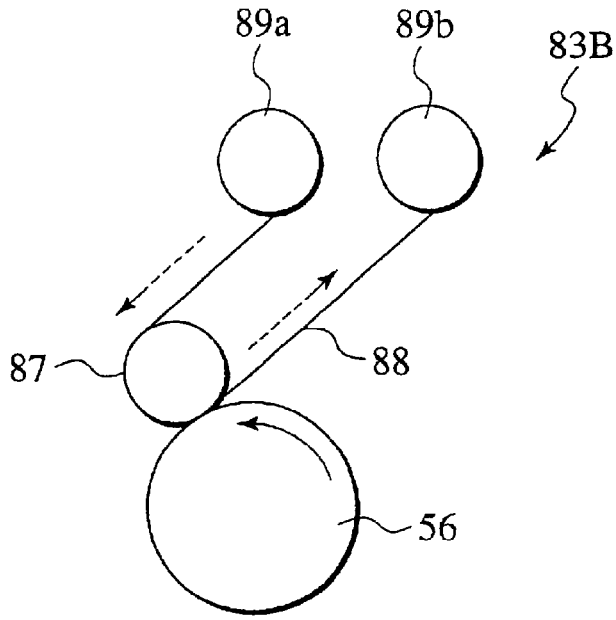
FIG. 15 is a schematic structural view of a liquid application unit of a seventh preferred embodiment according to the present invention.

The liquid application unit 83B of the seventh preferred embodiment shown in FIG. 15 is constructed of a sheet-like member 88 impregnated with liquid and held in pressured contact with the press roller 56 via a biasing roller 87, and a supply roller 89*a* and a winding roller 89*b* for moving the sheet-like member 88.

With such a seventh preferred embodiment, the sheet-like member 88 impregnated with liquid applies liquid onto the press roller 56 at adjustable abutting contact points to allow the abutting contact point of the press roller 56 to be gradually varied for thereby enabling application of liquid to the press roller 56 in an equally distributed fashion. Also, it is preferred that the sheet-like member 88 is moved at an extremely low speed relative to a peripheral speed of the press roller 56 to enhance an adequate contact between the sheet-like member 88 and the press roller 56. Further, the presence of the adjustable contact point between the sheet-like member 88 and the press roller 56 precludes an inadequate contact between the sheet-like member 88 and the press roller 56 owing to wear of the sheet-like member 88.

Figure 16:
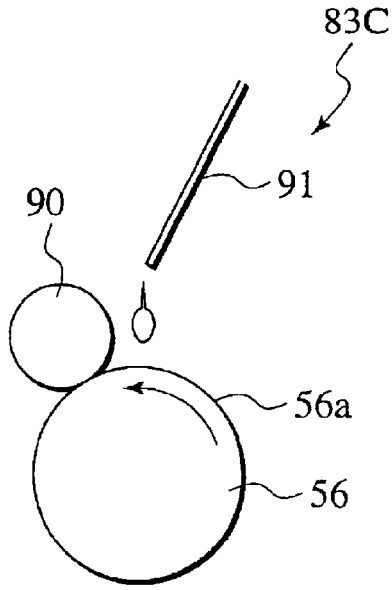
FIG. 16 is a schematic structural view of a liquid application unit of an eighth preferred embodiment according to the present invention.

The liquid application unit 83C of the eighth preferred embodiment shown in FIG. 16 is constructed of a biasing roller 90 held in pressured contact with the press roller 56 and composed of a biasing member which is able to be impregnated with liquid for retention, and a liquid supply unit 91 which applies liquid in drop phase to the outer periphery of the press roller 56 at a rotational upstream side of the biasing roller 90.

With such an eighth preferred embodiment, liquid supplied to the press roller 56 from the liquid supply unit 91 is equally leveled over the outer periphery 56*a* of the press roller 56 by means of the biasing roller 90 to uniformly apply liquid over the press roller 56. In addition, since it is possible to adjust the amount of liquid to be applied to the press roller 56 by the liquid supply unit 91, the press roller 56 is allowed to be applied with liquid with an optimum amount to preclude ink transfer in dependence on printing conditions. That is, since the amount of liquid, to be applied to the press roller, optimum for precluding ink transfer is varied according to the printing conditions such as print patterns, qualities of the print sheets and circumstances, it is possible for the press roller 56 to be applied with liquid in an amount optimum for precluding ink transfer in accordance with the printing conditions.

Further, although the biasing roller 90 may be fixedly located, the biasing roller 90 may be arranged to be freely rotated to follow the press roller 56, with a resultant advantage enabling liquid to be applied to the press roller 56 with little rotational load to be exerted thereto. Also, arranging the biasing roller 90 to be freely rotational allows rotational load, to be exerted to the press roller 56, to be substantially completely eliminated.

Figure 17:
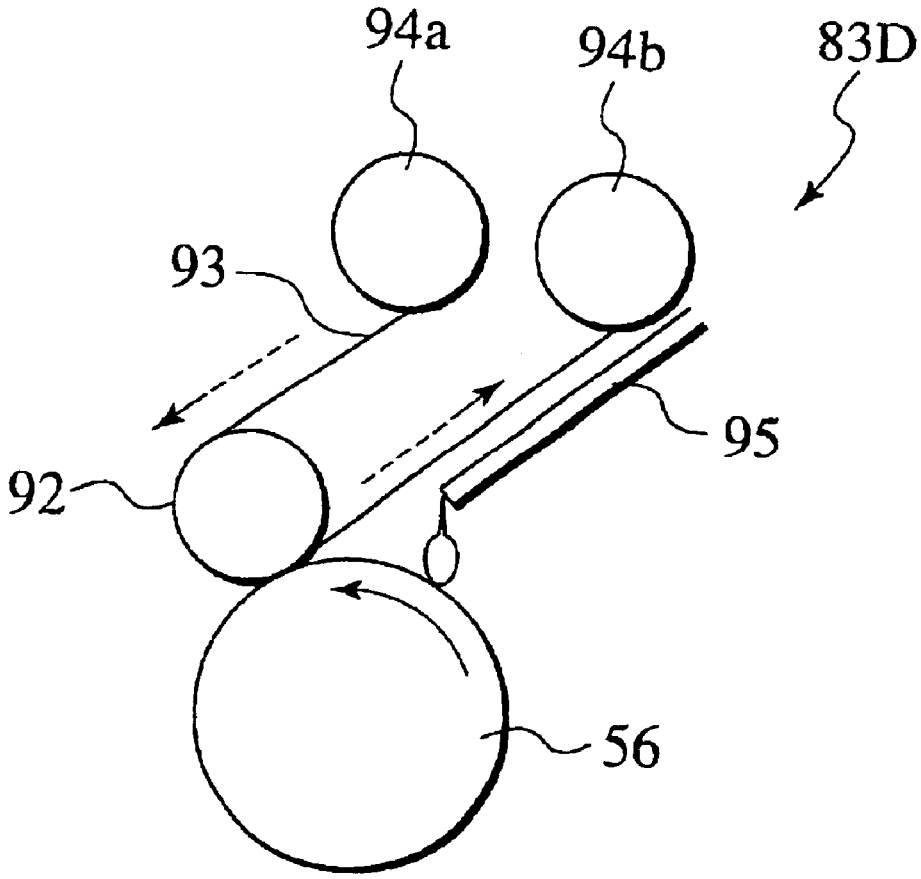
FIG. 17 is a schematic structural view of a liquid application unit of a ninth preferred embodiment according to the present invention.

The liquid application unit 83D of the ninth preferred embodiment shown in FIG. 17 is constructed of a sheet-like member 93 impregnated with liquid and held in pressured contact with the press roller 56 via a biasing roller 92, a supply roller 94*a* and a winding roller 94*b* for moving the sheet-like member 93, and a liquid supply unit 95 which applies liquid in drop phase to the outer periphery of the press roller 56 at a rotational upstream side of the biasing roller 92.

With such a ninth preferred embodiment, liquid supplied to the press roller 56 from the liquid supply unit 95 is equally leveled over the outer circumferential periphery 56*a* of the press roller 56 by means of the sheet-like member 93 to uniformly apply liquid over the outer circumferential periphery 56*a* of the press roller 56. In addition, since it is possible for the abutting contact point of the sheet-like member 93 relative to the press roller 56 to be varied, gradually adjusting the abutting contact point of the sheet-like member 93 relative to the press roller 56 allows liquid to be uniformly applied to the press roller 56. Also, since the amount of liquid, to be applied to the press roller 56, can be adjusted, it is possible for the press roller 56 to be applied with liquid in an amount optimum for precluding ink transfer in accordance with the printing conditions like in the aforementioned eighth preferred embodiment.

Also, it is preferred that the sheet-like member 93 is moved at an extremely low speed relative to a peripheral speed of the press roller 56 to enhance an adequate contact between the sheet-like member 93 and the press roller 56. Further, the presence of the adjustable contact point between the sheet-like member 93 and the press roller 56 precludes an inadequate contact between the sheet-like member 93 and the press roller 56 owing to wear of the sheet-like member 93.

Liquid used in the aforementioned sixth to ninth preferred embodiments may preferably have the viscosity in the range below 500 millipascal·second and more preferably below 100 millipascal·second. Liquid is composed of, for example, silicone oil.

Although the aforementioned respective preferred embodiments have been described with reference to the press roller 56, which serves as the downstream rotary press member of the stencil printing machine which enables the double-phase printing operation and which has the outer circumferential periphery 56*a* formed with the micro-convexities and concavities, the outer circumferential periphery of the press roller 46, which serves as the upstream rotary press member of the stencil printing machine of the double-phase printing type may be formed with the micro-convexities and concavities, or the outer circumferential periphery of the rotary press member of the stencil printing machine of the single-phase printing type may be formed with the micro-convexities and concavities.

That is, although there is an issue wherein there is a chance in that ink is transferred to the rotary press member in a case where the print sheet is not fed to the position between the printing drum and the rotary press member owing to a jamming effect and the press roller 56 is brought into directly pressurized contact with the stencil sheet, in a case where the print sheet, which is smaller in lateral size than the stencil sheet, is fed and the rotary press member is caused to be partly urged into directly pressured contact with the stencil sheet and in a case where the single-phase printing operation is carried out on one surface of the print sheet and subsequently printing operation is carried out on another surface of the print sheet with printing ink in a non-fixed state, causing transferred ink to be further transferred to the print sheet with a resultant contamination thereon, the presence of the micro-convexities and concavities formed over the press roller is highly effective as a contamination measure for the rotary press member and the print sheet.

In the aforementioned preferred embodiments, further, although the liquid application unit is constructed of the liquid application roller 70, the liquid application unit may be composed of an expedient which allows liquid to be applied to the outer circumferential periphery of the press roller 56. Also, although liquid is composed of silicone oil, liquid may be composed of liquid which provides no color formation due to contact between the print sheet 45 and the press roller 56 and which is not mixed with ink, or may be composed of water.

In accordance with the various preferred embodiments discussed above, although the rotary press member has been described as being composed of the press rollers 46, 56 with their diameters sufficiently smaller than those of the printing drums 40, 50, the rotary press member may be composed of a member which exerts a printing pressure between the printing drums 40, 50 or may be composed of a press drum with the same diameter as that of the printing drums 40, 50.

As previously described above, in accordance with the stencil printing machine according to the invention, wherein ink is transferred to print medium during the transfer stage in pressured contact thereof to perform the printing operation, the presence of the micro-convexities and concavities formed over the outer circumferential periphery of the rotary press member allows the outer circumferential periphery of the rotary press member to be merely formed with the micro-convexities and concavities such that even when the rotary press member is directly urged toward the stencil sheet, there is a few contact area between the rotary press member and ink or there is a few contact area between the outer circumferential periphery of the rotary press member and the non-fixed ink side of the printing medium. Accordingly, when the rotary press member is separated from the stencil sheet or when the rotary press member is separated from the printing medium, since the aforementioned ink or the non-fixed ink are not appreciably adhered to the rotary press member, it is possible for the printing medium to be prevented from being contaminated in a simplified structure with little decrease in the print density of printing medium.

In accordance with the invention, the presence of the convexities and concavities with the depth of the value above 0.035 mm formed at the outer circumferential periphery of the rotary press member allows the outer circumferential periphery of the rotary press member to have an increased difference in level in the convexities and the concavities of the outer circumferential periphery of the rotary press member when the rotary press member presses the printing drum via print medium. Thus, the concavities can not be nearly brought into contact with non-fixed ink of print medium for adequately precluding the transfer of non-fixed ink to the rotary press member, ensuring the visible contamination of print medium in a more reliable manner.

In accordance with the invention, the presence of the convexities and concavities with the depth of the value above 0.044 mm formed at the outer circumferential periphery of the rotary press member allows the outer circumferential periphery of the rotary press member to have an increased difference in level in the convexities and the concavities of the outer circumferential periphery of the rotary press member when the rotary press member presses the printing drum via print medium. This allows the concavities to remain in little or no contact with non-fixed ink and the transfer of non-fixed ink to the rotary press member can be adequately minimized, ensuring the visible contamination of print medium in a more reliable manner.

In accordance with the invention, the presence of the convexities and concavities, with the distance between the apexes in the range below 0.64 mm, formed at the outer circumferential periphery of the rotary press member allows the distance between the convexities and the concavities formed at the outer circumferential periphery of the rotary press member to have a narrow value when the rotary press member presses the printing drum via print medium to interrupt a visible convexity and concavity pattern from appearing on the print image, with a resultant image in a high quality.

In accordance with the invention, the presence of the convexities and the concavities, composed of the point-like convexities and concavities, of the outer circumferential periphery of the rotary press member allows the outer circumferential periphery of the rotary press member to be substantially equally formed with the convexities and the concavities in any direction, thereby precluding ink transfer in a substantially equal fashion in whole directions.

In accordance with the invention, the presence of the convexities and the concavities, composed of the line-shaped convexities and concavities orientated in the same direction as that which print medium is transferred, of the outer circumferential periphery of the rotary press member allows the outer circumferential periphery of the rotary press member to be regularly formed with definite convexities and the concavities in a direction perpendicular to the axial direction of the outer circumferential periphery of the rotary press member, thereby reliably preventing ink transfer in the direction perpendicular to the orientated direction of the line-shape.

In accordance with the invention, the presence of the convexities and the concavities including the point-like convexities and concavities, composed of the screen mesh, of the outer circumferential periphery of the rotary press member allows the screen mesh per se to be individually prepared which is located over the outer circumferential periphery of the rotary press member by covering the same with the mesh screen or by adhering the screen mesh to the same to form the micro-convexities and concavities, providing an ease of preparation of the point-like convexities and concavities.

In accordance with the invention, the presence of the convexities and the concavities including the point-like convexities and concavities, composed of the large number of spherical bodies, of the outer circumferential periphery of the rotary press member allows the large number of spherical bodies per se to be individually prepared which are located over the outer circumferential periphery of the rotary press member by adhesion to form the micro-convexities and the micro-concavities, providing an ease of preparation of the point-like convexities and concavities.

In accordance with the invention, the presence of the liquid application unit, which applies liquid over the outer circumferential periphery of the rotary press member, prevents a non-fixed ink portion from being split while allowing a liquid portion to be split, when the pressurized rotational member and print medium are separated from one another, for thereby precluding the rotary press member from being adhered with non-fixed ink, substantially completely avoiding print medium from being contaminated.

In accordance with the invention, the presence of liquid with the viscosity of a value below 1000 millipascal·second allows the liquid portion to be reliably split when the rotary press member and print medium are separated from one another to interrupt non-fixed ink from being adhered to the rotary press member for thereby completely preventing the contamination of print medium.

In accordance with the invention, the presence of liquid with the viscosity of a value below 500 millipascal·second allows the liquid portion to be reliably split when the rotary press member and print medium are separated from one another to interrupt non-fixed ink from being adhered to the rotary press member for thereby completely preventing the contamination of print medium.

In accordance with the invention, the presence of liquid composed of silicone oil allows the advantages of the invention to be obtained.

In accordance with the invention, the liquid application roller rotates with the rotary press member to apply liquid over the rotary press member with little rotational load to be exerted thereto.

In accordance with the invention, since the sheet-like member, impregnated with liquid, can be brought into pressured contact with the rotary press member at adjustable contact positions, gradually varying the contact positions at which the rotary press member is held in contact enables liquid to be applied to the rotary press member in a uniform fashion.

In accordance with the invention, the presence of the liquid supply unit, which can adjust the amount of liquid to be applied to the rotary press member, allows the amount of liquid to be adjusted to a value optimum for avoiding ink transfer according to the printing conditions, etc.

In accordance with the invention, since liquid, which is supplied to the rotary press member from the liquid supply unit, is completely applied to the outer circumferential periphery of the rotary press member with the sheet-like member, it is possible for the point of the sheet-like member, with which the rotary press member is held in abutting contact, to be varied while enabling adjustment of the amount of liquid to be applied to the rotary press member by means of the liquid supply unit.

In accordance with the stencil printing machine according to the invention, wherein the stencil printing machine has two sets of printing sections at the upstream side and the downstream side to perform the double-phase printing operation, the presence of the micro-convexities and the micro-concavities formed over the outer circumferential periphery of at least the downstream rotary press member allows the outer circumferential periphery of the downstream rotary press member to be merely formed with the micro-convexities and concavities such that there is little contact area between the outer circumferential periphery of the downstream rotary press member and the non-fixed ink side surface of the printing medium. Accordingly, when the rotary press member is separated from printing medium, since the rotary press member is not appreciably adhered with non-fixed ink, it is possible for the printing medium to be prevented from being contaminated in a simplified structure with little decrease in the print density of printing medium.

In accordance with the invention, the presence of the convexities and concavities with the depth of the value above 0.035 mm formed at the outer circumferential periphery of the rotary press member allows the outer circumferential periphery of the rotary press member to have an increased difference in level in the convexities and the concavities of the outer circumferential periphery of the rotary press member when the rotary press member presses the printing drum via print medium. Thus, the concavities can not be nearly brought into contact with non-fixed ink of print medium for adequately precluding the transfer of non-fixed ink to the rotary press member, ensuring the visible contamination of print medium in a more reliable manner.

In accordance with the invention, the presence of the convexities and concavities with the depth of the value above 0.044 mm formed at the outer circumferential periphery of the rotary press member allows the outer circumferential periphery of the rotary press member to have an increased difference in level in the convexities and the concavities of the outer circumferential periphery of the rotary press member when the rotary press member presses the printing drum via print medium. This allows the concavities to remain in little or no contact with non-fixed ink and the transfer of non-fixed ink to the rotary press member can be adequately minimized, ensuring the visible contamination of print medium in a more reliable manner.

In accordance with the invention, the presence of the convexities and concavities, with the distance between the apexes in the range below 0.64 mm, formed at the outer circumferential periphery of the rotary press member allows the distance between the convexities and the concavities formed at the outer circumferential periphery of the rotary press member to have a narrow value when the rotary press member presses the printing drum via print medium to interrupt a visible convexity and concavity pattern from appearing on the print image, with a resultant image in a high quality.

In accordance with the invention, the presence of the convexities and the concavities, composed of the point-like convexities and concavities, of the outer circumferential periphery of the rotary press member allows the outer circumferential periphery of the rotary press member to be substantially equally formed with the convexities and the concavities in any direction, thereby precluding ink transfer in a substantially equal fashion in whole directions.

In accordance with the invention, the presence of the convexities and the concavities, composed of the line-shaped convexities and concavities orientated in the same direction as that which print medium is transferred, of the outer circumferential periphery of the rotary press member allows the outer circumferential periphery of the rotary press member to be regularly formed with definite convexities and the concavities in a direction perpendicular to the axial direction of the outer circumferential periphery of the rotary press member, thereby reliably preventing ink transfer in the direction perpendicular to the orientated direction of the line-shape.

In accordance with the invention, the presence of the liquid application unit, which applies liquid over the outer circumferential periphery of the rotary press member, prevents a non-fixed ink portion from being split while allowing a liquid portion to be split, when the pressurized rotational member and print medium are separated from one another, for thereby precluding the rotary press member from being adhered with non-fixed ink, substantially completely avoiding print medium from being contaminated.

What is claimed is:

1. A stencil printing machine having two sets of printing sections located at an upstream side and a downstream side, respectively, and each composed of a rotary printing drum with an outer circumferential periphery to which a stencil sheet is mounted and a rotary press member which is movable between a pressurized position to be pressed against the outer circumferential periphery of the printing drum and a separated position to be separate from the outer circumferential periphery, a paper feed section for feeding print medium to the printing section at the upstream side, and an upstream transfer mechanism for transferring and feeding print medium, discharged from the printing section at the upstream side, to the printing section at the downstream side, wherein print medium, fed from the paper feed section to the printing section at the upstream side, is pressed between and transferred by the printing drum at the upstream side and the rotary press member both of which are rotated together, and during such a pressurized and transfer movement of print medium, one surface of print medium is transferred with ink and print medium is then fed to the printing section at the downstream side with the upstream transfer mechanism to allow print medium to be pressurized between and transferred by the printing drum and the rotational press member at the downstream side such that during such a pressurized and transfer movement, the other surface of print medium is transferred with ink to perform a double-phase printing operation, the stencil printing machine comprising:

at least said rotary press member, located at the downstream side member, including an outer circumferential periphery formed with micro-convexities and micro-concavities.

2. The stencil printing machine according to claim 1, wherein said micro-convexities and said micro-concavities of the outer circumferential periphery of said rotary press member has a depth of a value above 0.035 mm.

3. The stencil printing machine according to claim 1, wherein said micro-convexities and said micro-concavities of the outer circumferential periphery of said rotary press member has a depth of a value above 0.044 mm.

4. The stencil printing machine according to claim 1, wherein a distance between apexes of said micro-convexities and said micro-concavities of the outer circumferential periphery of said rotary press member has a value below 0.64 mm.

5. The stencil printing machine according to claim 1, wherein said micro convexities and said micro-concavities of the outer circumferential periphery of said rotary press member are composed of point-like convexities and concavities.

6. The stencil printing machine according to claim 1, wherein said micro-convexities and said micro-concavities of the outer circumferential periphery of said rotary press member are composed of line-shaped convexities and concavities which are oriented in the same direction as that which print medium is transferred.

7. The stencil printing machine according to claim 1, further comprising a liquid application unit for applying liquid to the outer circumferential periphery of said rotary press member.

8. A stencil printing machine having a printing section composed of a rotary printing drum with an outer circumferential periphery to which a stencil sheet is mounted and a rotary press member which is moveable between a pressurized position to be pressed against the outer circumferential periphery of said printing drum and a separated position to be separated from the outer circumferential periphery of said printing drum, and a paper feed section for feeding print medium between said printing drum and said rotary press member, wherein print medium, fed from the paper feed section, is pressed between and transferred by said printing drum and said rotary press member both of which are rotated together, and during such a pressurized and transfer movement of print medium, print medium is transferred with ink to perform a printing operation, the stencil printing machine comprising:

said rotary press member including an outer circumferential periphery formed with micro-convexities and micro-concavities.

9. The stencil printing machine according to claim 8, wherein said micro-convexities and said micro-concavities of the outer circumferential periphery of said rotary press member has a depth of a value above 0.035 mm.

10. The stencil printing machine according to claim 8, wherein said micro-convexities and said micro-concavities of the outer circumferential periphery of said rotary press member has a depth of a value above 0.444 mm.

11. The stencil printing machine according to claim 8, wherein a distance between apexes of said micro-convexities and said micro-concavities of the outer circumferential periphery of said rotary press member has a value below 0.64 mm.

12. The stencil printing machine according to claim 8, wherein said micro-convexities and said micro-concavities of the outer circumferential periphery of said rotary press member are composed of point-like convexities and concavities.

13. The stencil printing machine according to claim 12, wherein said point-like micro-convexities and micro-concavities of the outer circumferential periphery of said rotary press member are formed by locating a screen mesh to a surface of said rotary press member.

14. The stencil printing machine according to claim 12, wherein said point-like micro-convexities and micro-concavities of the outer circumferential periphery of said rotary press member are formed by locating a large number of spherical bodies to a surface of said rotary press member.

15. The stencil printing machine according to claim 8, wherein said micro-convexities and said micro-concavities of the outer circumferential periphery of said rotary press member are composed of line-shaped convexities and concavities which are oriented in the same direction as that which print medium is transferred.

16. The stencil printing machine according to claim 8, further comprising a liquid application unit for applying liquid to the outer circumferential periphery of said rotary press member.

17. The stencil printing machine according to claim 16, wherein said liquid has a viscosity of a value below 1000 millipascal·second.

18. The stencil printing machine according to claim 16, wherein said liquid has a viscosity of a value below 500 millipascal·second.

19. The stencil printing machine according to claim 16, wherein said liquid is composed of silicone oil.

20. The stencil printing machine according to claim 16, wherein said liquid application unit comprises a rotary liquid application roller held in pressured contact with said rotational press member, and a liquid supply unit for supplying liquid to an outer circumferential periphery of said liquid application roller, wherein said liquid application roller rotates with said rotary press member to apply liquid, supplied by said liquid supply unit, to the outer circumferential periphery of said rotary press member.

21. The stencil printing machine according to claim 16, wherein said liquid application unit comprises a sheet-like member held in abutting contact with said rotary press member and impregnated with liquid, said sheet-like member being moveable while held in abutting contact with said rotary press member.

22. The stencil printing machine according to claim 16, wherein said liquid application unit comprises a biasing member held in abutting contact with said rotary press member and impregnated with liquid which is retained in said biasing member, and a liquid supply unit for supplying liquid to the outer circumferential periphery of said rotary press member at a point upstream of said biasing member in a direction which said rotary press member rotates.

23. The stencil printing machine according to claim 16, wherein said liquid application unit comprises a sheet-like member held in abutting contact with said rotary press member at an adjustable contact area and moveable to vary the position of said adjustable contact area, and a liquid supply unit for supplying liquid to the outer circumferential periphery of said rotary press member at a point upstream of said adjustable contact area of said sheet-like member in a direction which said rotary press member rotates.

* * * * *